US007076199B2

(12) United States Patent
Nishida

(10) Patent No.: US 7,076,199 B2
(45) Date of Patent: Jul. 11, 2006

(54) IMAGE FORMING APPARATUS HAVING TRANSFER DEVICE PROVIDED IN CONTACT WITH IMAGE CARRYING BODY

(75) Inventor: Satoshi Nishida, Saitama (JP)

(73) Assignee: Konica Minolta Holdings, Inc., Tokyo (JP)

( * ) Notice: Subject to any disclaimer, the term of this patent is extended or adjusted under 35 U.S.C. 154(b) by 79 days.

(21) Appl. No.: 10/779,640

(22) Filed: Feb. 18, 2004

(65) Prior Publication Data

US 2004/0165919 A1 Aug. 26, 2004

(30) Foreign Application Priority Data

Feb. 21, 2003 (JP) ..... 2003-043730

(51) Int. Cl.
*G03G 21/00* (2006.01)

(52) U.S. Cl. ..... 399/346

(58) Field of Classification Search ..... 399/346, 399/159, 302, 308

See application file for complete search history.

(56) References Cited

U.S. PATENT DOCUMENTS 5,731,122 A * 3/1998 Yoshida et al. ..... 430/126
6,233,424 B1 * 5/2001 Mohri et al. ..... 399/320
6,760,562 B1 * 7/2004 Nishida et al. ..... 399/297

* cited by examiner

*Primary Examiner*—Quana Grainger
(74) *Attorney, Agent, or Firm*—Finnegan, Henderson, Farabow, Garrett & Dunner, L.L.P.

(57) ABSTRACT

An image forming apparatus in which a toner image on an image carrying body is transferred by a transfer device provided in contact with the image carrying body and a mutual relation between the respective surface properties of both the image carrying body and a transfer member to have a toner image transferred thereon being made to satisfy a specified relation described below: an angle of contact of the image carrying body for pure water when T second has passed after pure water was dropped on the surface is greater than an angle of contact of the transfer member for pure water when T second has passed after pure water was dropped on the surface, where T represents a transit time of toner particles through the contact area of the image carrying body with the transfer device.

16 Claims, 3 Drawing Sheets

IMAGE FORMING APPARATUS HAVING TRANSFER DEVICE PROVIDED IN CONTACT WITH IMAGE CARRYING BODY

BACKGROUND OF THE INVENTION

This invention relates to an image forming apparatus utilizing an electrophotographic method for example, and in particular, to an image forming apparatus equipped with a lubricant coating mechanism for coating a lubricant utilizing a brush roller for an image carrying body such as an image forming body and an intermediate transfer member on which a toner image is formed.

At present, in a certain kind of image forming apparatus utilizing, for example, an electrophotographic method, for the reason of improving the transfer performance and the development performance for example, when a transfer process is carried out, it is put into practice to carry out an image formation operation, for example, in a state that the mutual relation between the surface energy of both the image carrying body carrying a toner image and the image transfer member (for example, a transfer sheet, etc.) to have a toner image transferred, or the mutual relation between the angles of contact for pure water at the surface of both the members are adjusted so as to satisfy a specified relation, by the practice of a surface reforming processing for the image carrying body (image forming body for example) carrying a toner image.

Further, it is put into practice, in an image forming apparatus utilizing an intermediate transfer method, to set a state that the mutual relation between the respective surface properties of both the image carrying body carrying a toner image and the intermediate transfer member, and the mutual relation between the respective surface properties of both the intermediate transfer member and the transfer sheet satisfy a specified relation (refer to the publications of the unexamined patent applications H08-211755 and H07-52263, and U.S. Pat. No. 5,732,314, for example). For example, to state the magnitude relation on the angle of contact for pure water, it is necessary for the magnitude relation to satisfy the relation: image forming body (>intermediate transfer member)>transfer sheet.

For a concrete means for adjusting the surface property, for example, coating of a lubricant, adjustment of the surface roughness, and selection of the material of the structural member such as the image forming body can be cited.

It is generally considered that, by a surface reforming treatment of the structural members being done in such a manner as to satisfy the above-mentioned specified relation in the beginning of image formation operations made over a long period of time, to state it concretely, for example, by the continuous coating of a lubricant with a coating amount adjusted to satisfy the specified relation, the relation that is set at the early stage of the image formation operations over a long period of time is maintained irrespective of the number of times of image formation operations.

However, actually, in the case where after image formation operations have been carried out for a long period of time, an image formation operation is further carried out, a problem that the transfer ability of an image itself is lowered to cause an inside-void phenomenon be produced, which makes it difficult to form a high-quality image.

As regards such a problem, although it becomes different in accordance with the operation conditions of the image forming apparatus etc. for example, there is a case where the problem occurs at a point of time the number of times of image formation has exceeded ten thousand times.

SUMMARY OF THE INVENTION

This invention has been made on the basis of the above-mentioned things, and it is its object to provide an image forming apparatus which makes it possible to obtain expected development characteristics and expected transfer characteristics with certainty, even in the case where an image formation operation is further carried out after image formation operations have been repeated over a long period of time, and accordingly, is capable of forming high-quality images over a long period of time with certainty.

An image forming apparatus of this invention is an image forming apparatus in which a toner image on an image carrying body is transferred by a transfer means provided in contact with said image carrying body characterized by a mutual relation between the respective surface properties of both the image carrying body and a transfer-side member to have a toner image transferred thereon being made to satisfy a specified relation described below:

Relation: With the transit time of a toner particle (hereinafter referred to as "the transit time" or "nipping time" for simplicity's sake) through the contact area of the image carrying body with the transfer means denoted by T, the angle of contact of the image carrying body for pure water when T second has passed after pure water was dropped on the surface is greater than the angle of contact of the transfer-side member for pure water when T second has passed after pure water was dropped on the surface.

An image forming apparatus of this invention is an image forming apparatus in which a toner image formed on an image forming body is transferred onto a transfer sheet by a transfer means provided in contact with said image forming body characterized by being provided with a lubricant coating mechanism for coating a lubricant on the surface of the image forming body, said lubricant coating mechanism being equipped with a brush roller provided in a state of being contact with the surface of the image forming body and a lump of lubricant provided as pressed toward this brush roller, and having such a structure as to coat a small amount of lubricant scraped off said lump of lubricant on the surface of the image forming body by the rotation of the brush roller, said brush roller being rotated in the direction such that its periphery moves reversely to the progressing direction of the image forming body at its contact area with the image forming body, and being set in a state that the pressing load of the lump of lubricant against the brush roller is not less than 0.59 N and the coating amount of lubricant for the image forming body is such one that the consumption of said lump of lubricant per ten thousand times of image formation is 19.6 mg to 39.1 mg per the length 1 cm along the rotary axis of the brush roller, and the mutual relation between the respective surface properties of both the image forming body and the transfer sheet being made, by the lubricant being coated on the surface of the image forming body, to satisfy a specified relation (i) described below:

Relation (i): With the transit time through the contact area of the image forming body with the transfer means denoted by T1, the angle of contact of the image forming body for pure water when T1 second has passed after pure water was dropped on the surface is greater than the angle of contact of the transfer sheet for pure water when T1 second has passed after pure water was dropped on the surface.

In an image forming apparatus of this invention, it is desirable that the angle of contact of the aforesaid image forming member is made to be greater than the angle of contact of the aforesaid transfer sheet by 5°to 100° by the coating of a lubricant on the surface of the image forming body.

An image forming apparatus of this invention is an image forming apparatus in which a toner image formed on an image forming body is primarily transferred onto an intermediate transfer member provided in contact with said image forming body by a primary transfer means, and the primary transfer toner image on the intermediate transfer member is secondarily transferred onto a transfer sheet by a secondary transfer means provided in contact with said intermediate transfer member, characterized by a first lubricant coating mechanism for coating a lubricant on the surface of the image forming body, and a second lubricant coating mechanism for coating a lubricant on the surface of the intermediate transfer member being provided, said first lubricant coating mechanism and said second lubricant coating mechanism both being equipped with a brush roller provided in contact with the surface of the image forming body and a brush roller provided in contact with the surface of the intermediate transfer member respectively, and with their respective lumps of lubricant provided as pressed toward their respective brush rollers, and each having a structure such that a small amount of lubricant scraped off said lump of lubricant by the rotation of the brush roller is coated on the surface of the image forming body or the intermediate transfer member, said brush roller in the first lubricant coating mechanism being rotated in the direction such that its periphery moves reversely to the progressing direction of the image forming body at its contact area with the image forming body, and being set in a state that the pressing load of the lump of lubricant against the brush roller is not less than 0.59 N, which makes the coating amount of lubricant for the image forming body become such one that the consumption of the solid lubricant per ten thousand times of image formation is 19.6 mg to 39.1 mg per the length 1 cm along the rotary axis of the brush roller, said brush roller in the second lubricant coating mechanism being rotated in the direction such that its periphery moves in the same direction as the progressing direction of the intermediate transfer member at its contact area with the intermediate transfer member, and being set in a state that the pressing load of the lump of lubricant against the brush roller is not less than 0.29 N and which makes the coating amount of lubricant for the intermediate transfer member become such one that the consumption of the solid lubricant per ten thousand times of image formation is 5.0 mg to 19.5 mg per the length 1 cm along the rotary axis of the brush roller, and the mutual relation between the respective surface properties of both the image forming body and the intermediate transfer member being made, by the lubricant being coated on the surface of the image forming body, to satisfy a specified relation (ii) described below, while the mutual relation between the respective surface properties of both the intermediate transfer member and the transfer sheet being made, by the lubricant being coated on the surface of the intermediate transfer member, to satisfy a specified relation (iii) described below:

Relation (ii): With the transit time through the contact area of the image carrying body with the intermediate transfer member denoted by T2, the angle of contact of the image forming body for pure water when T2 second has passed after pure water was dropped on the surface is greater than the angle of contact of the intermediate transfer member for pure water when T2 second has passed after pure water was dropped on the surface.

Relation (iii): With the transit time through the contact area of the intermediate transfer member with the secondary transfer means denoted by T3, the angle of contact of the intermediate transfer member for pure water when T3 second has passed after pure water was dropped on the surface is greater than the angle of contact of the transfer sheet for pure water when T3 second has passed after pure water was dropped on the surface.

In an image forming apparatus of this invention, it is desirable that the angle of contact of the aforesaid image forming member is made to be greater than the angle of contact of the aforesaid intermediate transfer member by 5° to 30° by the coating of a lubricant on the surface of the image forming body, and at the same time, the angle of contact of said intermediate transfer member is made to be greater than the angle of contact of said transfer sheet by 5° to 90° by the coating of a lubricant on the surface of the intermediate transfer member.

An image forming apparatus of this invention is an image forming apparatus in which a toner image formed on an image forming body is primarily transferred onto an intermediate transfer member provided in contact with said image forming body by a primary transfer means, the primary transfer toner image on the intermediate transfer member is transferred onto a transfer sheet by a secondary transfer means provided in contact with said intermediate transfer member, and the toner particles adhering to the secondary transfer means are again transferred onto the intermediate transfer member by an electric field to remove said toner particles, characterized by a lubricant coating mechanism for coating a lubricant on the surface of the secondary transfer means being provided, said lubricant coating mechanism being equipped with a brush roller provided in contact with the surface of the secondary transfer means, and with a lump of lubricant provided as pressed toward the brush roller, and having a structure such that a small amount of lubricant scraped off the lump of lubricant by the rotation of the brush roller is coated on the surface of the secondary transfer means, said brush roller being rotated in the direction such that its periphery moves in the same direction as the progressing direction of the secondary transfer means at its contact area with the secondary transfer means, and being set in a state that the pressing load of the lump of lubricant against the brush roller is not less than 0.29 N, which makes the coating amount of lubricant for the secondary transfer means become such one that the consumption of the solid lubricant per ten thousand times of image formation is 5.0 mg to 39.6 mg per the length 1 cm along the rotary axis of the brush roller, and the mutual relation between the respective surface properties of both the intermediate transfer member and the secondary transfer means being made, by the lubricant being coated on the surface of the secondary transfer means, to satisfy a specified relation (iv) described below:

Relation (iv): With the transit time through the contact area of the intermediate transfer member with the secondary transfer means denoted by T4, the angle of contact of the secondary transfer means for pure water when T4 second has passed after pure water was dropped on the surface is greater than the angle of contact of the intermediate transfer member for pure water when T4 second has passed after pure water was dropped on the surface.

In an image forming apparatus of this invention, it is desirable that the angle of contact of the aforesaid secondary transfer means is made to be greater than the angle of contact of the aforesaid intermediate transfer member by 5° to 40° by the coating of a lubricant on the surface of the secondary transfer means.

Further, in an image forming apparatus of this invention it is possible to adjust the coating amount of lubricant the pressing load of the lump of lubricant against the brush roller being adjusted.

Further, in an image forming apparatus of this invention, it is possible to adjust the magnitude of the angle of contact of the aforesaid intermediate transfer member by the surface roughness of the intermediate transfer member being adjusted, and also it is possible to adjust the magnitude of the angle of contact of said intermediate transfer member by the reforming of the surface of the intermediate transfer member for its wettability being carried out by a plasma processing.

By an image forming apparatus having the above-mentioned structure, because an image formation operation is carried out in a state that, when the transfer process is carried out, the mutual relation between the respective surface properties of both the image carrying body carrying a toner image (for example, an image forming body or an intermediate transfer member) and the transfer-side member to have a toner image on the image carrying body transferred (for example, an intermediate transfer member or a transfer sheet) is set in such a way as to satisfy a specified relation, the expected transfer characteristics can be obtained with certainty, and high-quality images can be obtained over a long period of time with certainty.

By the structure of the lubricant coating mechanism being made to continuously coat a lubricant on the surface of an image carrying body at a specified amount of coating, even after image formation operations have been carried out over a long period of time, it is possible to maintain a state that the mutual relation between the respective surface properties of both the image carrying body carrying a toner image and the transfer-side member to have the toner image transferred satisfies a specified relation, and image formation operations are carried out in this state. Therefore, the expected transfer characteristics can be obtained with certainty, and high-quality images can be obtained over a long period of time with certainty.

DETAILED DESCRIPTION OF THE PREFERRED EMBODIMENT

In the following, this invention will be explained in detail with reference to the drawings.

Figure 1:
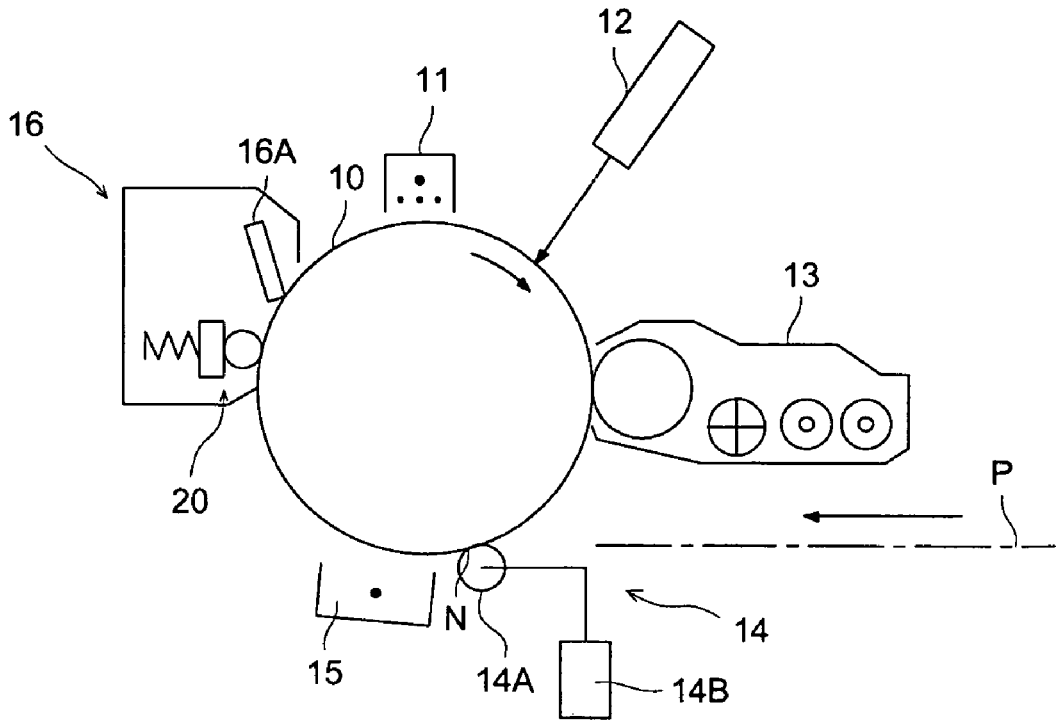
FIG. 1 is an illustrative drawing showing the outline of the structure of an example of an image forming apparatus of this invention.
Figure 2:
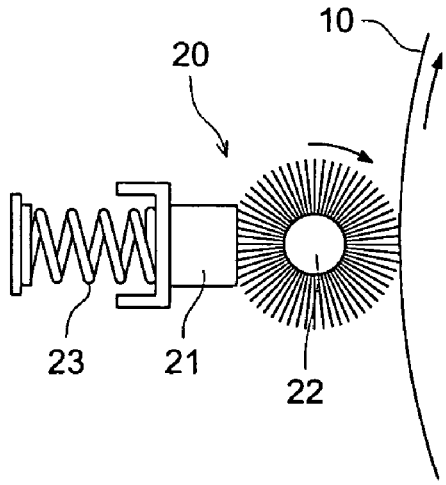
FIG. 2 is an illustrative drawing showing a state that a brush roller in a lubricant coating mechanism is in contact with the image forming apparatus.

FIG. 1 is an illustrative drawing showing the outline of the structure of an example of an image forming apparatus of this invention, and FIG. 2 is an illustrative drawing showing a state that a brush roller in a lubricant coating mechanism is in contact with the image forming apparatus.

This image forming apparatus is equipped with a drum-shaped image forming body 10 which is an image carrying body to be rotated, a charging means 11 for charging the surface of the image forming body 10, an exposure means 12 for forming an electrostatic latent image by applying an exposure to the surface of the image forming body 10, a development means 13 for forming a toner image by visualizing an electrostatic latent image by means of a developer containing toner particles, a transfer means 14 for transferring a toner image on the image forming body 10 onto a transfer sheet P as a transfer-side member at a transfer nip portion N, a separation means 15 for separating a transfer sheet P being in a state in close contact with the image forming body 10, and a cleaning means 16 for removing residual toner particles on the image forming body having passed the transfer nip portion N by means of a cleaning blade 16A.

The image forming body 10 is made up of an organic photoreceptor formed of a photosensitive layer composed of resin containing an organic photoconductor on the outer circumferential surface of a drum-shaped metal substrate, and is arranged in such a manner as to extend in the width direction (the direction perpendicular to the page in FIG. 1) of the transfer sheet P being conveyed.

For the resin as a constituent of the photosensitive layer, for example, polycarbonate etc. can be cited.

It is desirable that the image forming body 10 is formed of a photosensitive layer of a separated-function type composed of a charge transport layer and a charge generation layer superposed.

It is desirable that the image forming body 10 has a surface roughness of 0.1 μm to 0.3 μm in terms of a surface roughness expressed by ten point height of irregularities Rz according to JIS B0601.

The transfer means 14 is made up of a transfer roller 14A arranged in such a manner as to form the transfer nip portion N in a state of being pressed onto the surface of the image forming body, and a bias voltage applying means 14B made up, for example, of a constant-current source connected to this transfer roller 14A, and is one of what is called a contact-transfer type by which a toner image on the image forming body 10 is transferred to a transfer sheet by the application of a transfer bias voltage controlled to have a suitable magnitude to the transfer roller 14A by means of the bias voltage applying means 14B to form a transfer electric field.

The transfer roller 14A has a structure having a cover layer made of rubber material such as, for example, polyurethane rubber, ethylene-propylene rubber (EPDM), silicone rubber having a conductive filler such as carbon dispersed therein or a cover layer made of semi-conductive rubber in a solid state or in a foamed-sponge state containing an ionic conductive material formed on the circumferential surface of a conductive metal core made of stainless steel for example.

It is desirable that the transfer roller 14A has a volume resistivity value of $10^5$ Ωcm to $10^{10}$ Ωcm.

It is desirable that the pressing load of the transfer roller 14A against the image forming body 10 is 6 N to 10 N.

The transfer electric current applied to the transfer roller 14A by the bias voltage applying means 14B has the polarity reverse to the charge polarity of the toner, and although it is changed with the magnitude of the resistance value of the transfer roller 14A, it is desirable that the current value is 1 μA to 200 μA.

In this image forming apparatus, at a position in the downstream side of the transfer nip portion N and in the upstream side of the cleaning area by the cleaning means 16 with respect to the rotating direction of the image forming body 10, there is provided a lubricant coating mechanism 20 for coating a lubricant on the surface of the image forming body 10, and in this example of practice, it is made up as a united body with the cleaning means 16.

The lubricant coating mechanism 20, as shown in FIG. 2, is equipped with a lump of lubricant 21 composed of zinc stearate for example, and a brush roller 22 for scraping the lubricant component off the surface of the lump of lubricant 21 by being rotated to rub its surface and coating it on the image forming body 10, and the lump of lubricant 21 is provided in a state of being urged by a pressing means 23 made up of a spring member for example and being pressed to the brush roller 22.

The brush roller 22 making up the lubricant coating mechanism 20 is formed of a long-sized woven fabric which has resinous brush fibers made of polypropylene for example planted in a high density and is spirally wound around the circumferential surface of a roller base to become roll-shaped, and is rotated by a suitable drive means such as a belt transmission mechanism in such a manner that its periphery moves in the direction reverse to the moving direction of the periphery of the image forming body 10 at the position where it is in contact with the image forming body 10.

The coating amount of the lubricant for the image forming body in this lubricant coating mechanism 20 is determined to be such one that the consumption of the lump of lubricant 21 per ten thousand times of image formation is 19.6 mg to 39.1 mg, or preferably 25 mg to 35 mg, per the length 1 cm in the direction of the rotary axis of the brush roller 22.

The coating amount of the lubricant can be controlled, for example, by the adjustment of the pressing load of the lump of lubricant 21 against the brush roller 22, and the pressing load of the lump of lubricant 21 against the brush roller 22 is determined to be not less than 0.59 N (60 gf), or preferably to be 0.78 N to 2.94 N (80 gf to 300 gf).

To show an example of the numerical values concerning the structure of the lubricant coating mechanism 20, for example, the thickness of each of the brush fibers of the brush roller 22 is 3 deniers to 7 deniers, the length of the brush fibers is 2 mm to 5 mm, the planting density of the brush fibers (the number of brush fibers per unit area) is 50,000 to 200,000 fibers/inch$^2$, the thrust amount of the brush roller against the image forming body 10 is 0.5 mm to 1.0 mm for example, and the rotational speed of the brush roller 22 (the peripheral speed) is 0.2 time to 2.0 times of the rotational speed (peripheral speed) of the image forming body 10. The term "thrust amount of the brush roller against the image forming body 10" means the maximum value of the quantities (length) concerning how much the end of the brush fibers project inside in case of no existence of the image forming body 10, from the outer circumferential surface position of the image forming body 10 in its normal direction.

In the foregoing example, the mutual relation between the respective surface properties of both the image forming body and the transfer sheet P is made to satisfy a specified relation (i) described below.

Specified relation (i): With the transit time through the area of the image forming body 10 in contact with the transfer roller 14A (the transfer nip portion N) denoted by T1 second, the angle of contact of the image forming body 10 for pure water when T1 second has passed after pure water was dropped on its surface (hereinafter referred to as "the angle of contact of the image forming body" simply) is greater than the angle of contact of the transfer sheet P for pure water when T1 second has passed after pure water was dropped on its surface (hereinafter referred to as "the angle of contact of the transfer sheet" simply).

To state it concretely, it is preferable that the angle of contact of the image forming body is made to be greater than the angle of contact of the transfer sheet P by at least 5° to 100° or more preferably 10° to 100°. By this, even after image formation operations are practiced over a long period of time, it is possible to obtain the expected development characteristics and the expected transfer characteristics with certainty.

As regards the angle of contact for pure water, it was used a value measured by means of an angle of contact meter "CA-DT: type A" (manufactured by KYOWA INTERFACE SCIENCE Co., Ltd.) using a liquid drop method (detailed description of the measurement procedure is described in the handling manual).

In the above-mentioned image forming apparatus, an image formation operation is carried out in the following way.

That is, when the image forming body 10 is driven to rotate, the brush roller 22 is rotated by a suitable drive mechanism. By this, some amount of lubricant that is scraped off the surface of the lump of lubricant 21 rubbed by the brush roller 22 is coated on the surface of the image forming body 10 at a controlled coating amount to form a lubricant film. And in this state, a charging process by the charging means 11, an exposure process by the exposure means 12, and a development process by the development means 13 are carried out successively, to form a toner image on the surface of the image forming body 10.

Further, by a transfer electric current being supplied to the transfer roller 14A by the bias voltage applying means 14B with its magnitude controlled, a transfer electric field is formed in the transfer nip portion N, and after the toner image on the image forming member 10 is transferred onto a transfer sheet P by the above-mentioned transfer electric field, a separation process by the separation means 15 and a fixing process by a fixing means (not shown in the drawing) are carried out to form a fixed image on the transfer sheet P.

On the other hand, residual toner particles having passed the transfer nip portion N and remaining on the surface of the image forming body 10 are removed by the cleaning means 16; that is, in a state where, by the brush roller 22, lubricant is coated on the surface of the image forming body 10 and a part of the remaining toner particles is scraped off and removed, substantially, the whole of the other part of the remaining toner particles are removed by the cleaning blade 16A.

Thus, by an image forming apparatus having the above-mentioned structure in which lubricant is continuously coated on the surface of the image forming body 10 at a specified coating amount, even in the case where after image formation operations are carried out over a long period of time, an image formation operation is further carried out, it is possible to prevent with certainty that a poor transfer such as an inside-void phenomenon etc. is produced, which makes it possible to obtain the expected transfer characteristics. The reason for this is such one as shown in the following.

That is, in such an image forming apparatus, it has been considered that, so long as the angle of contact of the image forming body 10 is determined to be greater than the angle of contact of the transfer sheet P, and a specified amount of lubricant is continuously coated on the surface of the image forming body 10, the mutual relation in the initial stage of a long-period image formation operations can be maintained irrespective of the number of times of image formation. However, it has been proved that, actually, in the case where image formation operations extending over a long period of time have been made, for example, in the case where image formation operations of 1,000 times to 10,000 times have been carried out, it starts to occur a phenomenon such that the angle of contact of the image forming body 10 varies to become smaller than the angle of contact of the transfer sheet P in such an extremely short time (considerably short period of time such as less than 100 ms, as compared with conventionally measured period of time such as 1 sec. to 10 s) as the transit time T1 through the area of the image forming body 10 in contact with the transfer roller 14A. As the reason for this, the following can be considered: at the point of time pure water was dropped, due to the existence of a lubricant which is, for example, an external additive of the toner attached by a long-term use, the surface of the image forming body is in a state of being difficult to wet, and the angle of contact of the image forming body 10 indicates a value larger than the angle of contact of the transfer sheet P. However, because some adhering substances other than the lubricant of the toner exist, the surface gradually becomes capable of being wetted with the passage of time, owing to the capillary tube phenomenon caused by the minute clearance between the adhering substances.

Accordingly, by the coating of lubricant on the image forming body 10 at a specified coating amount determined with the change of the angle of contact of the image forming body 10 caused by a long-term use of the image forming apparatus and the change of it caused by the surface becoming in contact with the transfer roller 14A in the transfer nip portion N a large number of times taken into consideration, without producing a problem such that the reversing phenomenon of the mutual relation between the respective angles of contact of both the image forming body 10 and the transfer sheet P (the angle of contact of the image forming body 10<the angle of contact of the transfer sheet P) after the image forming body 10 has undergone 10,000 to 100,000 times of image formation operations, although the above-mentioned problem is produced if the lubricant is coated at a coating amount determined in such a way as to satisfy a specified relation merely in the initial stage of the image formation operations (at the time of the designing), a state such that the mutual relation between the respective surface properties of both the image forming body 10 and the transfer sheet P satisfies the specified relation (the angle of contact of the image forming body 10>the angle of contact of the transfer sheet P) is maintained with certainty. In addition, as will be clear from the examples of experiment to be described later, without producing a problem that the development characteristics such as the image density are lowered, which is produced if the coating amount of the lubricant is merely increased, the expected development characteristics and the expected transfer characteristics can be obtained over a long period of time with certainty. Due to this, a high-quality image can be formed with certainty.

In the foregoing, a case where this invention is applied to a monochromatic image forming apparatus has been explained, but this invention can be applied to a color image forming apparatus too.

Figure 3:
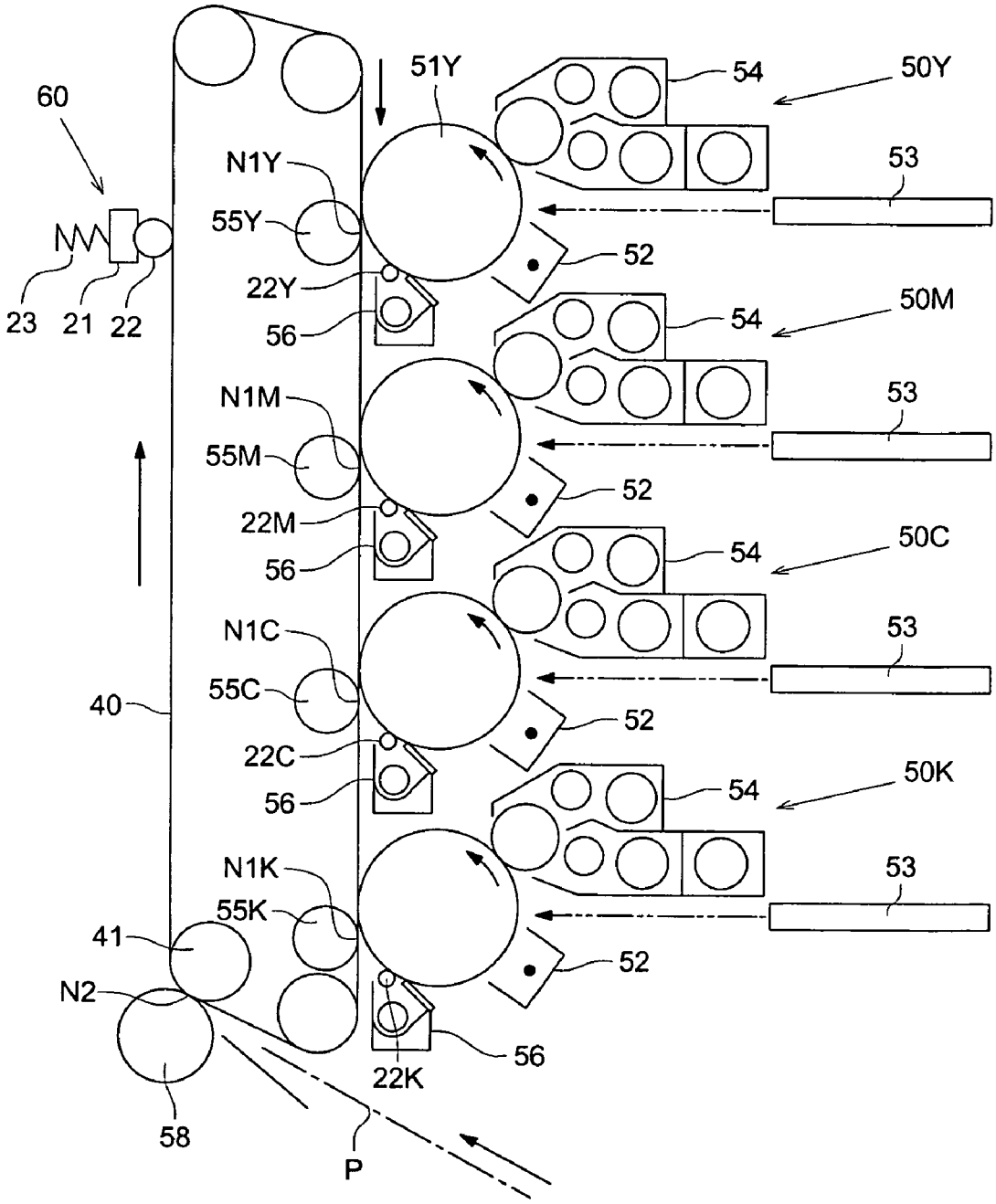
FIG. 3 is an illustrative drawing showing the outline of the structure of another example of an image forming apparatus of this invention.

FIG. 3 is an illustrative drawing showing the outline of the structure of another example of an image forming apparatus of this invention.

This image forming apparatus is one of what is called an intermediate transfer type, in which toner images of mutually different colors formed on their respective image forming bodies are transferred several times (for example, 4 times) one after another to become toner images of their respective colors superposed on said intermediate transfer member, and the composite toner image formed thereon is concurrently transferred onto a transfer sheet, to form a color toner image.

To explain it concretely, this color image forming apparatus has four toner image forming units 50Y, 50M, 50C, and 50K for forming toner images of the respective colors arranged in an array apart from one another, and an endless intermediate transfer belt 40 as an intermediate transfer member provided in a state of being trained about a plurality of support rollers including a backup roller 41 making up a secondary transfer means to be described later so as to be moved in circulation as it is made to face each of the image forming bodies 51Y, 51M, 51C, and 51K each formed of an organic photoreceptor for example by the primary transfer rollers 55Y, 55M, 55C, and 55K in their respective toner image forming units 50Y, 50M, 50C, and 50K.

In FIG. 3, the sign 52 denotes a charging means, 53 denotes an exposure means, 54 denotes a development means, and 56 denotes an image forming body cleaning means.

In the yellow toner image forming unit 50Y for forming a yellow toner image, at a downstream position of the development zone by the development means 54 in the rotating direction of the image forming body 51Y, the primary transfer roller 55Y is provided in such a manner as to form a primary transfer nip portion N1Y by being pressed to the image forming body 51Y with the intermediate transfer belt 40 held in between, and it is made up a primary transfer means of a contact transfer type which primarily transfers a toner image on the image forming body 51Y onto the intermediate transfer belt 40, by a transfer electric field formed in the primary transfer nip portion N1Y through the application of a transfer bias voltage with its magnitude controlled at a suitable magnitude to the primary transfer roller 55Y.

As regards the toner image forming units 50M, 50C, and 50K for forming a magenta toner image, a cyan toner image, and a black toner image respectively, they have a structure similar to the toner image forming unit 50Y for forming a yellow toner image. The structural members the same as those in the toner image forming unit 50Y for forming a yellow toner image are noted with the respective same signs or with the respective signs in which Y is substituted by M, C, or K attached.

As regards the intermediate transfer belt 40, it is desirable that its surface roughness is larger than the surface roughness of each of the image forming bodies 51Y, 51M, 51C, and 51K in the toner image forming units for forming a toner image of the respective colors by 0.5 μm to 1.0 μm, and the material for making up the intermediate transfer belt 40 is selected in accordance with the structural material of the image forming bodies 51Y, 51M, 51C, and 51K for example (the material of the photosensitive layer).

Further, it is desirable that the intermediate transfer belt 40 is composed of semiconductive resin having its resistivity value of $1\times10^{4}$ Ωcm to $1\times10^{12}$ Ωcm.

To state it concretely, a resin material such as polyimide (PI), polyamideimide (PAI), polyvinylidene fluoride (PVDF), tetrafluoroethylene-ethylene copolymer (ETFE), or the like, a rubber material such as ethylene-propylene rubber (EPDM), acrylonitrile-butadiene rubber (NBR), chloroprene rubber (CR), polyurethane rubber, or the like having a conductive filler such as carbon dispersed therein or containing ionic conductive material, or the like can be used.

At a downstream position of the area where the toner image forming units are disposed with respect to the moving direction of the intermediate transfer belt 40, there is provided a secondary transfer roller 58 in such a way as to form a secondary transfer nip portion N2 pressed by the backup roller 41 through the intermediate transfer belt 40, and it is made up a secondary transfer means of a contact transfer type which transfers the primary transfer toner image on said intermediate transfer belt 40 onto a transfer sheet having been conveyed, by the application of a transfer bias voltage of a proper magnitude by a bias voltage applying means (not shown in the drawing) made up, for example, of a constant-current source connected to the above-mentioned secondary transfer roller 58.

To state it concretely, it is desirable that the secondary transfer roller 58 is located in such a way as to form the secondary transfer nip portion N2 at a position within a range of ±10 mm with respect to the central position of the area where a transfer sheet is to be brought in contact with the intermediate transfer belt 40 in the conveyance direction of the transfer sheet P.

In the secondary transfer means, there is provided a drive mechanism (not shown in the drawing) for moving the secondary transfer roller 58 in the direction of its getting away from the intermediate transfer belt 40, and in the case where an image formation operation is not carried out, the secondary transfer roller 58 is made to get away from the intermediate transfer belt 40 to be brought in a non-contact state, while in the case where a primary transfer toner image formed on the intermediate transfer belt 40 is transferred onto a transfer sheet P (in the case where an image formation operation is carried out), the secondary transfer roller 58 is made to be in contact with the intermediate transfer belt 40 to be brought in a contact state.

The secondary transfer roller 58 is made up of a semi-conductive cover layer made of an elastomer formed on the outer circumferential surface of a cylindrical conductive metal core made of stainless steel for example.

For the elastomer making up the cover layer, it is not limited to a particular one, and for example, a rubber material such as polyurethane rubber, ethylene-propylene rubber (EPDM), and silicone rubber having a conductive filler such as carbon dispersed therein, said rubber material containing ionic conductive material, or the like can be cited.

It is desirable that the secondary transfer roller 58 has a volume resistivity value of $1\times10^5$ Ωcm to $1\times10^7$ Ωcm, and has a rubber hardness (Asker C hardness) of 20° to 70°.

The backup roller 41 is composed of a cylindrical conductive metal core made of stainless steel for example and a semiconductive cover layer made of an elastomer formed on the outer circumferential surface of the metal core.

For the material to form the cover layer, one that is shown as an example of the material for making up the cover layer of the secondary transfer roller 58 can be used.

It is desirable that the backup roller 41 has a volume resistivity value of $1\times10^5$ Ωcm to $1\times10^7$ Ωcm.

The bias voltage applying means has a function to apply a removal bias voltage having the polarity opposite to the polarity of a transfer bias voltage for transferring a color toner image on the intermediate transfer belt 40 onto a transfer sheet P; by the application of a removal bias voltage, toner particles adhering on the secondary transfer roller 58 are again transferred onto the intermediate transfer belt 40, and are removed by an intermediate transfer member cleaning device (not shown in the drawing) together with the residual toner particles remaining on the intermediate transfer belt 40.

In this color image forming apparatus, a plurality of lubricant coating mechanisms corresponding to their respective image forming bodies 51Y, 51M, 51C, and 51K in their respective toner image forming units for forming respective color toner images 50Y, 50M, 50C, and 50K are provided at positions in the downstream side of the primary transfer nip portions N1Y, N1M, N1C, and N1K with in the rotating direction of the image forming bodies 51Y, 51M, 51C, and 51K respectively, while a lubricant coating mechanism for coating the intermediate transfer belt 40 with a lubricant is provided at a position in the downstream side of the secondary transfer nip N2 and in the upstream side of the area where each of the toner image forming units is arranged in the moving direction of the intermediate transfer belt 40.

As regards the lubricant coating mechanisms for their respective image forming bodies 51Y, 51M, 51C, and 51K, they have a basic structure similar to the one shown in FIG. 2, and are equipped with respective lumps of lubricant 21 composed of zinc stearate for example and their respective brush rollers 22Y, 22M, 22C, and 22K for scraping some amount of lubricant off the surface of the respective lumps of lubricant 21 by being rotated to rub the surface of the lumps of lubricant and coating the surface of the image forming bodies 51Y, 51M, 51C, and 51K respectively with the lubricant. Each of the lumps of lubricant 21 is urged by a pressing means 23 made up of a spring member for example, to be pressed to each of the brush rollers 22Y, 22M, 22C, and 22K.

The brush rollers 22Y, 22M, 22C, and 22K each is rotated by a suitable drive means such as a belt transmission mechanism in such a manner that their peripheries move in the direction reverse to the moving direction of the peripheries of the respective image forming bodies 51Y, 51M, 51C, and 51K (the counter direction) at the contact position with the respective image forming bodies 51Y, 51M, 51C, and 51K.

The coating amount of lubricant in the lubricant coating mechanisms for their respective image forming bodies 51Y, 51M, 51C, and 51K is determined to be such one that the consumption of each of the lumps of lubricant 21 per 10,000 times of image formation becomes 19.6 mg to 39.1 mg, or more preferably 25 mg to 35 mg per length 1 cm along the rotary axis direction of the respective brush rollers 22Y, 22M, 22C, and 22K.

The coating amount of lubricant can be controlled, for example, by the adjustment of the pressing load of the lumps of lubricant 21 against their respective brush rollers 22Y, 22M, 22C, and 22K, which are determined to be not greater than 0.59N (60 gf) each, or more preferably 0.72 N to 2.94 N (80 gf to 300 gf).

As regards the lubricant coating mechanism 60 for the intermediate transfer belt 40 also, the basic structure is similar to the one shown in FIG. 2, and it is equipped with a lump of lubricant 21 composed of zinc stearate for example, and a brush roller 22 for scraping some amount of lubricant off the lump of lubricant 21 by being rotated to rub its surface and coating the surface of the intermediate transfer belt 40 with the lubricant scraped, said lump of lubricant 21 being urged by a pressing means 23 made up, for example, of a spring member, to be pressed to the brush roller 22.

The brush roller 22 is rotated by a suitable drive means such as a belt transmission mechanism in such a manner that its periphery moves in the same direction as the moving direction of the intermediate transfer belt 40 at the contact position with the intermediate transfer belt 40. The rotating speed of the brush roller 22 (the brush peripheral speed) is, for example, of a magnitude of 1.2 times of the moving speed of the intermediate transfer belt 40 or greater.

The coating amount of lubricant for the intermediate transfer belt 40 is determined to be such one that the consumption of each of the lumps of lubricant per 10,000 times of image formation becomes 5 mg to 19.5 mg, or more preferably 10 mg to 15 mg per length 1 cm along the rotary axis direction of the brush roller 22.

The coating amount of lubricant can be controlled, for example, by the adjustment of the pressing load of the lumps of lubricant 21 against the brush roller 22, which is determined to be not greater than 0.29N (30 gf), or more preferably 0.59 N to 0.98 N (60 gf to 100 gf).

In the example explained above, a suitable amount of lubricant is coated on the surface of each of the image forming bodies 51Y, 51M, 51C, and 51K, and the mutual relation between the respective surface properties of both each of the image forming bodies 51Y, 51M, 51C, and 51K and the intermediate transfer belt 40 is made to satisfy a specified relation (ii) described below, while the mutual relation between the respective surface properties of both the intermediate transfer belt 40 and the transfer sheet P is made to satisfy a specified relation (iii).

Specified relation (ii): With the transit time through the contact area of the each of the image carrying bodies 51Y, 51M, 51C, and 51K with the intermediate transfer belt 40 denoted by T1 second, the angle of contact of each of the image forming bodies 51Y, 51M, 51C, and 51K for pure water when T1 second has passed after pure water was dropped on the surface (hereinafter referred to as "the angle of contact of the image forming body) is greater than the angle of contact of the intermediate transfer belt 40 for pure water when T1 second has passed after pure water was dropped on its surface (hereinafter referred to as" the first angle of contact of the intermediate transfer belt).

Specified relation (iii): With the transit time through the contact area of the intermediate transfer belt 40 with the transfer sheet P denoted by T2 second, the angle of contact of the intermediate transfer belt 40 for pure water when T2 second has passed after pure water was dropped on its surface (hereinafter referred to as "the second angle of contact of the intermediate transfer belt) is greater than the angle of contact of the transfer sheet P for pure water when T2 second has passed after pure water was dropped on its surface (hereinafter referred to as" the angle of contact of the transfer sheet).

To state it concretely, it is preferable that the angle of contact of the image forming bodies 51Y, 51M, 51C, and 51K is made to be greater than the first angle of contact of the intermediate transfer belt 40 by at least 5° or more, or more preferably 10° to 20°.

Further, it is preferable that the second angle of contact of the intermediate transfer belt 40 is made to be greater than at least 5° or more, or more preferably 10° to 30°.

By the above-mentioned image forming apparatus having a structure such that a specified amount of lubricant is continuously coated on the surface of the image forming bodies 51Y, 51M, 51C, and 51K while another specified amount of lubricant is coated on the surface of the intermediate transfer belt 40, even in the case where after image formation operations made over a long period of time, an image formation operation is further carried out, it is established a state that the mutual relation between the respective surface properties of both each of the image forming bodies 51Y, 51M, 51C, and 51K and the intermediate transfer belt 40 in the primary transfer process satisfies the specified relation (the angle of contact of the image forming body>the first angle of contact of the intermediate transfer belt 40), and also the mutual relation between the respective surface properties of both the intermediate transfer belt 40 and the transfer sheet P satisfies the specified relation (the second angle of contact of the intermediate transfer belt 40>the angle of contact of the transfer sheet P). In addition, it never occurs a problem that the development characteristics such as the image density are lowered as is produced in the case where the coating amount of the lubricant is merely increased. Therefore, the expected development characteristics and the expected transfer characteristics can be obtained over a long period of time with certainty, which makes it possible to form high-quality images with certainty.

Figure 4:
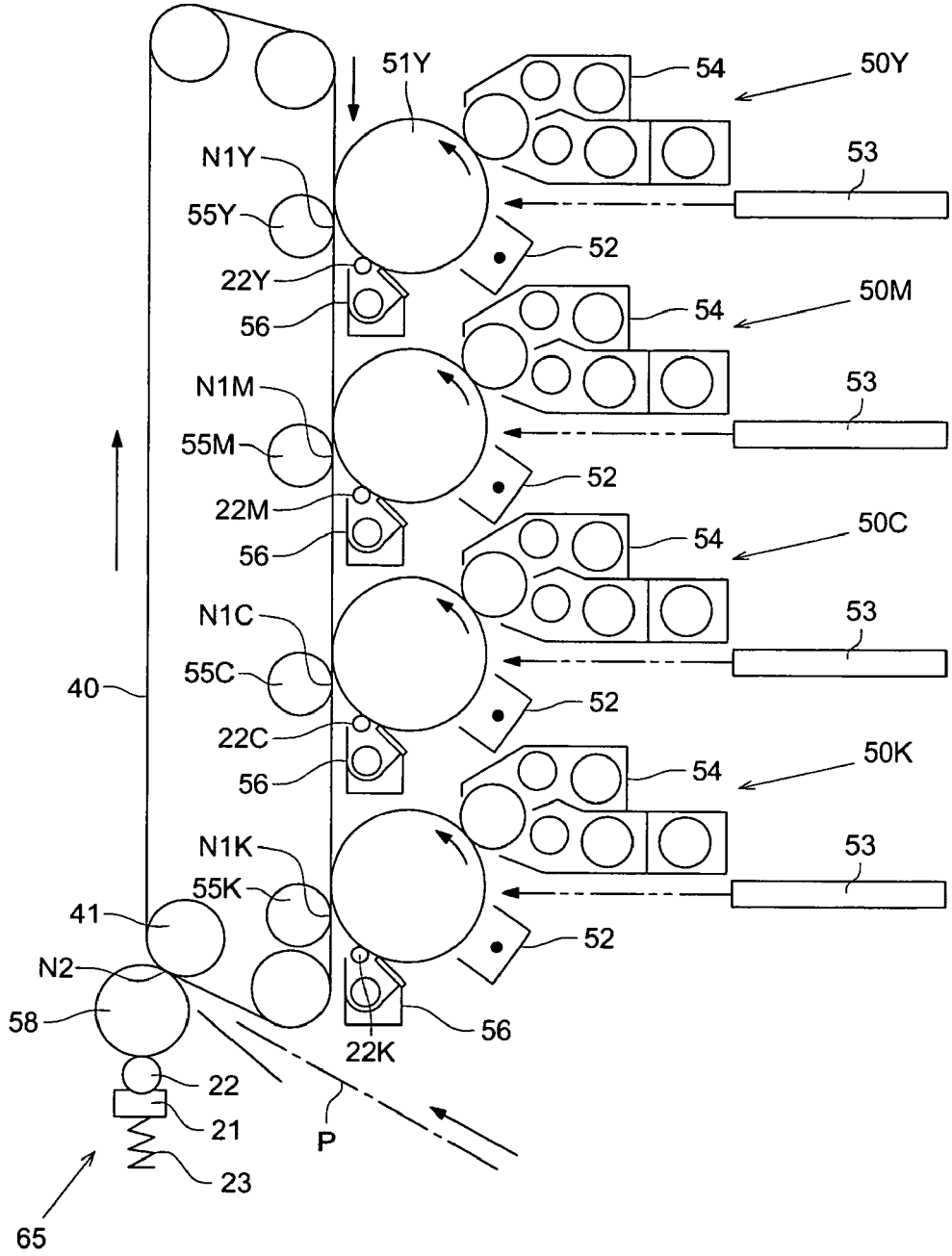
FIG. 4 is an illustrative drawing showing the outline of the structure of further another example of an image forming apparatus of this invention.

The color image forming apparatus as described in the foregoing can be made, as shown in FIG. 4, to have a structure equipped with a lubricant coating mechanism 65 for coating the surface of the secondary transfer roller 58 with a lubricant.

To state it concretely, at a position in the downstream side of the secondary transfer nip portion N2 with respect to the rotating direction of the secondary transfer roller 58, there is provided the lubricant coating mechanism 65 having the structure shown in FIG. 2 in a state that the brush roller 22 is in contact with the secondary transfer roller 58, and the color image forming apparatus has a structure similar to one that is shown in FIG. 3 except that it has no lubricant coating mechanism for the intermediate transfer belt 40.

In the lubricant coating mechanism 65 for the secondary transfer roller 58, the coating amount of the lubricant is determined to be such one that the consumption of the lump of lubricant 21 per 10,000 times of image formation becomes 5 mg to 39.6 mg, or more preferably 10 mg to 35 mg per the length 1 cm along the direction of the rotary axis of the brush roller 22.

The coating amount of lubricant can be controlled, for example, by the adjustment of the pressing load of the lump of lubricant 21 against the brush roller 22, which is determined to be not less than 0.29 N (30 gf), or more preferably, 0.49 N (50 gf) to 0.98 N (100 gf).

By the coating of lubricant on the surface of the secondary transfer roller 58, the mutual relation between the respective surface properties of both the intermediate transfer belt 40 and the secondary transfer roller 58 is made to satisfy a specified relation (iv).

Specified relation (iv): With the transit time through the contact area of the intermediate transfer belt 40 with the secondary transfer roller 58 (secondary transfer nip portion) denoted by T4 second, the angle of contact of the secondary transfer roller 58 for pure water when T4 second has passed after pure water was dropped on its surface is greater than the angle of contact of the intermediate transfer belt 40 for pure water when T4 second has passed after pure water was dropped on its surface (hereinafter referred to as "the third angle of contact of the intermediate transfer belt).

To state it concretely, it is preferable to make the angle of contact of the secondary transfer roller 58 be greater than the third angle of contact of the intermediate transfer belt 40 by 5° to 40°, or more preferably 10° to 20°.

By such an image forming apparatus, by the surface of the image forming bodies 51Y, 51M, 51C, and 51K being coated with a controlled amount of lubricant, and the surface of the secondary transfer roller 58 being coated with another controlled amount of lubricant, even in the case after image formation operations made over a long period of time, an image formation operation is further carried out, it is established and can be maintained a state that the mutual relation between the respective surface properties of both each of the image forming bodies 51Y, 51M, 51C, and 51K in their respective image forming units for forming the respective color toner images and the intermediate transfer belt 40 and the mutual relation between the respective surface properties of both the intermediate transfer belt and the transfer sheet satisfy their respective specified relations, and on top of it, because the secondary transfer roller 58 comes to have a sufficient releasing ability and the adhering force of toner particles to the secondary transfer roller 58 is lowered, the removal of toner particles adhering to said secondary transfer roller 58 by the removal electric field can be carried out with certainty; therefore, the expected development characteristics and the expected transfer characteristics can be obtained with certainty, which makes it possible to form high-quality images having no smudges etc. on the rear surface of the transfer sheet with certainty.

In the foregoing cases, an image forming apparatus of this invention is particularly useful in the case where a toner requiring a severe transfer process condition as shown in the toners (1) and (2) described below is used.

(1) A toner composed of toner particles having number-average particle diameter of 3 μm to 8 μm.

(2) A toner composed of toner particles having a coefficient of variation of the shape factor that is not greater than 16%, and a coefficient of number variation in the number distribution of particle diameter that is not greater than 27%.

A shape factor of a toner is expressed by the equation 1 described below, and indicates a degree of roundness of toner particles.

$$\text{Shape factor}=\{(\text{maximum diameter}/2)^2\cdot\times\pi\}/\text{projection area} \qquad \text{Equation 1:}$$

In the above equation, the maximum diameter is expressed by the interval of the couple of parallel lines having the maximum value of the interval among a number of arbitrary couples of parallel lines drawn tangentially to the projection image of a toner particle on a plane. Further, a projection area means the area of a projection image of a toner particle on a plane.

In this invention, this shape factor was measured in the following way. That is, an enlarged photograph of a toner particle was taken by means of a scanning-type electron microscope of 2,000 magnifications, and subsequently, on the basis of this photograph, the analysis of the photograph image was carried out by means of "SCANNING IMAGE ANALYZER" (manufactured by JEOL, Ltd.). At this time, by the use of 100 toner particles, the shape factor was measured and calculated by the above-mentioned equation for calculation.

The coefficient of variation of the shape factor of a toner is calculated from the equation 2 described below.

$$\text{Coefficient of variation of shape factor}=(S1/K)\times 100(\%). \qquad \text{Equation 2:}$$

In the equation 2, S1 denotes the standard deviation of the shape factor of 100 toner particles, and K denotes the average of the shape factor.

For the number distribution of particle diameter and the number-average coefficient of variation of particle diameter of a toner, values which are measured by a "Coulter Counter TA-II" or a "Coulter Multisizer" (both are manufactured by Coulter Co., Ltd.) are used. In this invention, a Coulter Multisizer connected with an interface for outputting a particle diameter distribution and a personal computer was used. As regards the aperture to be used in the above-mentioned Coulter Multisizer, one having a size of 100 μm was used, the volume and the number of toner particles larger than 2 μm were measured, and the particle diameter distribution and the average diameter were calculated. A number distribution of particle diameter represents the relative frequency of toner particles vs. particle diameter, and a number-average particle diameter D represents the median diameter in the number distribution of particle diameter. The "number-average coefficient of variation in the number distribution of particle diameter" of a toner is calculated from the equation 3 described below.

$$\text{number-average coefficient of variation of particle diameter}=[S2/D]\times 100(\%). \qquad \text{Equation 3:}$$

In the equation 3, S2 denotes the standard deviation of particle diameter of a toner, and D denotes the number-average particle diameter of a toner (μm).

Up to now, the embodiment of this invention has been explained. This invention, however, is not to be limited to the above-mentioned modes of the embodiment, but it is possible to add various kinds of modification to the invention.

For example, it is also appropriate to make, by the application of a reforming treatment for the surface property such as an adjustment treatment for the surface roughness or a wettability reforming treatment by a plasma processing to the intermediate transfer member and a further coating of a controlled amount of lubricant on it, the mutual relation of the respective surface properties of both the image forming body and the intermediate transfer member in the primary transfer process, and the mutual relation of the respective surface properties of both the intermediate transfer member and the transfer sheet in the secondary transfer process satisfy the specified relations respectively.

To state it concretely, in the case where the surface property is adjusted by the practice of an adjustment processing of the surface roughness in addition to the coating of lubricant, for example, by a smoothing processing of the surface of the intermediate transfer member, the surface roughness of the intermediate transfer member is made to be greater than the surface roughness of the image forming body by 0.5 μm to 1.0 μm.

Further, in the case where the surface property is adjusted by the practice of a wettability reforming treatment by a plasma processing in addition to the coating of lubricant, for example, by the application of a plasma processing to the intermediate transfer member to make higher the wettability of the intermediate transfer member, the angle of contact of the intermediate transfer member is made to be less than the angle of contact of the image forming body by 5° to 30°.

As regards the transfer sheet to be used in the practice of an image formation operation, its material is not to be limited to a particular one; it is appropriate to adjust the process conditions, for example, by the adjustment of the coating amount of lubricant through the adjustment of pressing load of the lump of lubricant against the brush roller in accordance with the kind of the transfer sheet, in order that the respective surface properties of both the member carrying a toner image and the transfer sheet may satisfy the specified relation in the transfer process of a toner image to the transfer sheet.

In the following, examples of experiment which were carried out for the purpose of confirmation of the effect of this invention will be explained.

EXAMPLE OF EXPERIMENT 1

In accordance with the structure of FIG. 1, an image forming apparatus of this invention was manufactured. The concrete structure is such one as shown below.

(1) For the image forming body, it was used an organic photoreceptor made up of a photosensitive layer composed of polycarbonate containing phthalocyanine pigment having a thickness of 25 μm formed on a cylindrical substrate having an outer diameter of 60 mm and a length of 335 mm in the axial direction, the photosensitive layer having a surface roughness of 0.2 μm in terms of ten point height of irregularities according to JIS B0601, and the peripheral speed was determined to be 180 mm/s.

(2) For the charging means, a scorotron charging device having a positive discharging characteristic was used.

(3) For the exposure means, a semiconductor laser emission device having a surface standard output of 300 μW was used.

(4) For the development means, it was used a development device of a two-component type loaded with a developer containing a toner composed of toner particles having a number-average particle diameter of 6.5 μm and a coefficient of variation of the shape factor of 12% with a toner concentration of 4% by weight.

(5) For the transfer means, one of a contact transfer type composed of a transfer roller as described below and a constant-current source connected to it was used.

Transfer roller: One composed of a metal core made of stainless steel and a cover layer made of semiconductive rubber in a foamed sponge state composed of silicone resin with carbon dispersed therein formed on the surface of the metal core, having an outer diameter of 20 mm and a volume resistivity of $1\times10^6$ Ωcm was used.

The pressing contact load against the image forming body was determined to be 19.6 N (2 kgf), which made the transfer nip width 5 mm and the transit time through the contact area between the organic photoreceptor and the transfer roller (T1) 28 ms.

(6) For the lubricant coating mechanism for the organic photoreceptor, one having the structure shown in FIG. 2 was used. The concrete structure will be shown in the following.

Brush roller: One having brush fibers of "SA-7" (produced by Toray Industries, Inc.) with a thickness of 6.25 denier planted at a density of 50,000 fibers/inch$^2$, an outer diameter of 18 mm, and a length of 335 mm in the axial direction, was set with a thrust amount against the organic photoreceptor of 1 mm, to be rotated at a peripheral speed of 180 mm/s in the direction reverse to the moving direction of the periphery of the organic photoreceptor at the contact position with the organic photoreceptor.

Lump of lubricant: one in a solid state having a vertical dimension of 8 mm, a lateral dimension of 8 mm, and a length in the axial direction of 335 mm made of zinc stearate was set in a state that the pressing load against the brush roller was 1.96 N (200 gf), and the thrust amount of the brush roller against the lump of lubricant was 1 mm.

The coating amount of lubricant for the organic photoreceptor was determined to be such one that the consumption of the lump of lubricant per 10,000 times of image formation was 30 mg per the length 1 cm along the axial direction of the lump of lubricant.

(7) For the transfer sheet, one having a surface smoothness of 30 s according to the specification of JIS-P8119 was used.

By the coating of lubricant on the surface of the organic photoreceptor by means of the lubricant coating mechanism, the angle of contact of the organic photoreceptor for pure water when T1 second passed after pure water was dropped on the surface was made to be 109°, and the angle of contact of the transfer sheet when T1 second passed after pure water was dropped on the surface was made to be 50° (the angle of contact of the organic photoreceptor>the angle of contact of the transfer sheet).

In the above-mentioned example, an actual print test to form copy images of 200,000 sheets in total was carried out continuously, and for each of the output image obtained by the first image formation operation and the output image obtained by the 200,000th image formation operation, evaluations for the image density and whether or not an inside-void image caused by transfer was produced were carried out; it was confirmed that both the obtained output images had expected image density and no inside-void phenomenon by transfer produced.

EXAMPLE OF EXPERIMENT FOR COMPARISON 1

In the image forming apparatus which was used in the example of experiment 1, the same actual print test as that in the example of experiment 1 was carried out, except that the pressing load of the lump of lubricant against the brush roller was determined to be 0.29 N (30 gf), which made the coating amount of lubricant such one that the consumption of the lump of lubricant per 10,000 times of image formation 8 mg per the length 1 cm along the axial direction. As the result, it was confirmed that the output image obtained by the 200,000th image formation operation had an inside-void portion by transfer produced.

EXAMPLE OF EXPERIMENT FOR COMPARISON 2

In the image forming apparatus which was used in the example of experiment 1, the same actual print test as that in the example of experiment 1 was carried out, except that the pressing load of the lump of lubricant against the brush roller was determined to be 7.84 N (800 gf), which made the coating amount of lubricant such one that the consumption of the lump of lubricant per 10,000 times of image formation 120 mg per the length 1 cm along the axial direction. As the result, it was confirmed that neither the output image obtained by the first image formation operation nor the output image obtained by the 200,000th image formation operation had the expected image density.

EXAMPLE OF EXPERIMENT 2

An image forming apparatus of this invention was manufactured in accordance with the structure of FIG. 3. The concrete structure is such one as shown below.

The toner image forming units for forming the respective color toner images all have the same structure, and the inter-axis distance between the rotary axes of two neighboring toner image forming units was designed to be 95 mm.

(1) For the image forming body, it was used an organic photoreceptor made up of a photosensitive layer composed of polycarbonate containing phthalocyanine pigment having a thickness of 25 μm formed on a cylindrical substrate having an outer diameter of 60 mm and a length of 335 mm in the axial direction, the photosensitive layer having a surface roughness of 0.2 μm in terms of ten point height of irregularities according to JIS B0601, and the peripheral speed was determined to be 220 mm/s.

(2) For the charging means, a scorotron charging device having a positive discharging characteristic was used.

(3) For the exposure means, a semiconductor laser emission device having a surface standard output of 300 μW was used.

(4) For the development means, it was used a development device of a two-component type loaded with a developer containing a toner composed of toner particles having a number-average particle diameter of 6.5 μm and a coefficient of variation of the shape factor of 12% with a toner concentration of 4% by weight.

(5) For the primary transfer means, one of a contact transfer type having a structure as described below and a constant-current source connected to it was used.

For the primary transfer roller, one that was composed of a metal core made of stainless steel and a cover layer made of semiconductive rubber in a foamed sponge state composed of silicone resin with carbon dispersed therein formed on the surface of the metal core, and had an outer diameter of 20 mm and a volume resistivity of $1\times10^6$ Ωcm was used.

The pressing contact load of the primary transfer roller against the organic photoreceptor was determined to be 4.9 N (500 gf), which made the transfer nip width be 6 mm and the transit time through the contact area between the organic photoreceptor and the transfer roller (T2) be 28 ms.

(6) For each of the lubricant coating mechanisms for their respective organic photoreceptors in the toner image forming units, one having the structure shown in FIG. 2 was used. The concrete structure was the same as that in the above-mentioned example of experiment 1.

The pressing load of the lump of lubricant against the brush roller was determined to be 1.96 N (200 gf), and the coating amount of lubricant for the organic photoreceptor was determined to be such one that the consumption of the lump of lubricant per 10,000 times of image formation was 30 mg per the length 1 cm along the axial direction of the lump of lubricant.

(7) For the intermediate transfer member, an endless semiconductive resin belt made of polyimide having a volume resistivity of $1\times10^8$ Ωcm was used, and the peripheral speed of the intermediate transfer belt was determined to be 220 mm/s. The surface roughness of the intermediate transfer belt in terms of ten point height of irregularities according to JIS B0601 was 1.0 μm.

Each of the support rollers including the backup roller had an outer diameter of 31.6 mm, and the backup roller had a volume resistivity of $5\times10^7$ Ωcm (measurement condition: load 10 N (1 kgf), applied voltage 1 kV).

(8) For the lubricant coating mechanism for the intermediate transfer belt, one having the structure shown in FIG. 2 was used. The concrete structure was the same as the lubricant coating mechanism for the organic photoreceptor; the pressing load of the lump of lubricant against the brush roller was determined to be 0.78 N (80 gf), which made the coating amount of lubricant for the intermediate transfer belt determined be such one that the consumption of the lump of lubricant per 10,000 times of image formation was 15 mg per the length 1 cm along the axial direction of the lump of lubricant.

(9) For the secondary transfer means, one of a contact transfer type having a structure as described below and a constant-current source connected to it was used.

For the secondary transfer roller, one that was composed of a metal core made of stainless steel and a cover layer made of semiconductive rubber in a foamed sponge state composed of silicone resin with carbon dispersed therein formed on the surface of the metal core and had an outer diameter of 30 mm and a volume resistivity of $5\times10^7$ Ωcm was used.

The secondary transfer roller was pressed in contact with the intermediate transfer belt in a state that the transfer nip width was 4 mm and the transit time through the contact area between the intermediate transfer belt and the secondary transfer roller (T3) was 18 ms.

(10) For the transfer sheet, one having a surface smoothness of 30 s according to the specification of JIS-P8119 was used. The angle of contact of the transfer sheet for pure water when T3 second passed after pure water was dropped was 50°.

By the coating of lubricant on the surface of the organic photoreceptor and the coating of lubricant on the surface of the intermediate transfer belt by means of the respective lubricant coating mechanisms, the angle of contact of the organic photoreceptor for pure water when T2 second passed after pure water was dropped on the surface was made to be 109°, and the angle of contact of the intermediate transfer belt when T2 second passed after pure water was dropped on the surface was made to be 80° (the angle of contact of the organic photoreceptor>the angle of contact of the intermediate transfer belt); on top of it, the angle of contact of the intermediate transfer belt for pure water when T3 second passed after pure water was dropped on the surface was made to be 85° (the angle of contact of the intermediate transfer belt>the angle of contact of the transfer sheet).

In the above-mentioned example, an actual print test to form copy images of 200,000 sheets in total was carried out continuously, and for each of the output image obtained by the first image formation operation and the output image obtained by the 200,000th image formation operation, evaluations for the image density and whether or not an inside-void image caused by transfer was produced were carried out; it was confirmed that both the obtained output images had expected image density and no inside-void phenomenon by transfer produced.

EXAMPLE OF EXPERIMENT FOR COMPARISON 3

In the image forming apparatus which was used in the example of experiment 2, the same actual print test as that in the example of experiment 2 was carried out, except that the pressing load of the lump of lubricant against the brush roller was determined to be 0.29 N (30 gf) in the lubricant coating mechanism for the intermediate transfer belt, which made the coating amount of lubricant such one that the consumption of the lump of lubricant per 10,000 times of image formation 3 mg per the length 1 cm along the axial direction. As the result, it was confirmed that the output image obtained by the 200,000th image formation operation had an inside-void portion by transfer produced.

EXAMPLE OF EXPERIMENT FOR COMPARISON 4

In the image forming apparatus which was used in the example of experiment 1, the same actual print test as that in the example of experiment 1 was carried out, except that the pressing load of the lump of lubricant against the brush roller was determined to be 7.84 N (800 gf) in the lubricant coating mechanism for the intermediate transfer belt, which made the coating amount of lubricant such one that the consumption of the lump of lubricant per 10,000 times of image formation 120 mg per the length 1 cm along the axial direction. As the result, it was confirmed that neither the output image obtained by the first image formation operation nor the output image obtained by the 200,000th image formation operation had the expected image density.

EXAMPLE OF EXPERIMENT 3

It was manufactured an image forming apparatus having the same structure as that of the image forming apparatus of the example of experiment, except that a lubricant coating mechanism for coating lubricant for the secondary transfer roller is provided instead of the lubricant coating mechanism for the intermediate transfer belt in the image forming apparatus which was used in the example of experiment 2.

For the lubricant coating mechanism for the secondary transfer roller, one having the same structure as the lubricant coating mechanism for the intermediate transfer belt in the example of experiment 2 was used; the pressing load of the lump of lubricant against the brush roller was determined to be 0.78 N (80 gf), which made the coating amount of lubricant for the intermediate transfer belt determined be such one that the consumption of the lump of lubricant per 10,000 times of image formation was 15 mg per the length 1 cm along the axial direction of the lump of lubricant.

By the coating of lubricant on the surface of the secondary transfer roller by means of the lubricant coating mechanism, the angle of contact of the secondary transfer roller for pure water when T3 second passed after pure water was dropped on the surface was made to be 105°, and the angle of contact of the intermediate transfer belt when T3 second passed after pure water was dropped on the surface was made to be 85° (the angle of contact of the secondary transfer roller>the angle of contact of the intermediate transfer belt).

In the above-mentioned example, an actual print test to form copy images of 200,000 sheets in total was carried out continuously, and for each of the output image obtained by the first image formation operation and the output image obtained by the 200,000th image formation operation, evaluations for whether or not background image density was produced and whether or not smudging on the rear side of the transfer sheet was produced were carried out; as the result, it was confirmed that both the obtained output images had the expected image density and had no problem such as the smudging on the rear side of the transfer sheet produced.

EXAMPLE OF EXPERIMENT FOR COMPARISON 5

In the image forming apparatus which was used in the example of experiment 3, the same actual print test as that in the example of experiment 3 was carried out, except that the pressing load of the lump of lubricant against the brush roller was determined to be 0.29N (30 gf) in the lubricant coating mechanism for the secondary transfer roller, which made the coating amount of lubricant for the secondary roller such one that the consumption of the lump of lubricant per 10,000 times of image formation be 3 mg per the length 1 cm along the axial direction. As the result, it was confirmed that in the output image obtained by the 200,000th image formation, smudging of the rear side of the transfer sheet was produced due to the toner adhesion to the secondary transfer roller.

EXAMPLE OF EXPERIMENT FOR COMPARISON 6

In the image forming apparatus which was used in the example of experiment 3, the same actual print test as that in the example of experiment 3 was carried out, except that the pressing load of the lump of lubricant against the brush roller was determined to be 7.84 N (800 gf) in the lubricant coating mechanism for the secondary transfer roller, which made the coating amount of lubricant for the secondary roller such one that the consumption of the lump of lubricant per 10,000 times of image formation be 120 mg per the length 1 cm along the axial direction. As the result, it was confirmed that there is no problem in terms of the performance, but the secondary transfer area was smudged with the lubricant powder owing to the excessive supply of the lubricant, and the conditions used in this example was judged to be not applicable to actual use.

By an image forming apparatus of this invention, image formation operations are carried out in a state that, when a transfer process is carried out, the mutual relation between the respective surface properties of both the member carrying a toner image (for example, the image forming body or the intermediate transfer member) and the member to have a toner image transferred thereon (for example, the intermediate transfer member or the transfer sheet) satisfies a specified relation; therefore, the expected transfer characteristics and the expected development characteristics can be obtained with certainty, and high-quality images can be formed over a long period of time with certainty.

Owing to the structure such that the surface of the image forming body is coated with a specified amount of lubricant continuously, even in cases where after image formation operations are carried out over a long period of time, an image formation operation is further carried out, it can be maintained a state that the mutual relation between the respective surface properties of both the member carrying a toner image and the member to have a toner image transferred thereon satisfies a specified relation, and image formation operations are carried out in this state; therefore, the expected transfer characteristics and the expected development characteristics can be obtained with certainty, and high-quality images can be formed over a long period of time with certainty.

Owing to the structure such that the surface of the secondary transfer means is coated with a specified amount of lubricant continuously, it is possible to transfer toner particles adhering to the secondary transfer means onto the intermediate transfer member to remove them with certainty from the secondary transfer means, which makes it possible to prevent with certainty that the smudging of the rear side of a transfer sheet is produced.

What is claimed is:

1. An image forming apparatus comprising:

(a) an image forming body on which a toner image is formed;

(b) a transfer device provided in contact with the image forming body for transferring the toner image formed on the image forming body onto a transfer material; and (c) a lubricant coating mechanism comprising a brush roller provided in contact with a surface of the image forming body and a lump of lubricant which is pressed toward the brush roller, for coating a small amount of lubricant scraped off the lump of lubricant on the surface of the image forming body by rotating the brush roller, wherein the brush roller is rotated in a direction such that a periphery thereof moves reversely to a progressing direction of the image forming body at a contact area with the image forming body, and is set in a state that a pressing load of the lump of lubricant against the brush roller not less than 0.59 N and a coating amount of the lubricant for the image forming body is such that a consumption of the lump of lubricant per ten thousand times of image formation is 19.6 mg to 39.1 mg per a length of 1 cm along a rotary axis of the brush roller, and the following specific mutual relation with respect to a surface property between the image forming body and the transfer material is satisfied:

an angle of contact of the image forming body for pure water when T seconds have passed after pure water was dropped on a surface thereof is greater than an angle of contact of the transfer material for pure water when T seconds have passed after pure water was dropped on a surface thereof, where T represents a transit time of toner particles through the contact area of the image forming body with the transfer device.

2. The image forming apparatus of claim 1, wherein the angle of contact of the image forming body is greater than the angle of contact of the transfer material by 5° to 100° by the coating of the lubricant on the surface of the image forming body.

3. An image forming apparatus comprising:

(a) an image forming body on which a toner image is formed;

(b) a primary transfer device provided in contact with the image forming body for primarily transferring the toner image formed on the image forming body onto an intermediate transfer member;

(c) a secondary transfer device provided in contact with the intermediate transfer member for secondarily transferring the toner image primarily transferred on the intermediate transfer member onto a transfer material;

(d) a first lubricant coating mechanism for coating a lubricant on a surface of the image forming body; and (e) a second lubricant coating mechanism for coating a lubricant on a surface of the intermediate transfer member, wherein the first lubricant coating mechanism comprises a first brush roller provided in contact with a surface of the image forming body, and a lump of lubricant which is pressed toward the first brush roller for coating a small amount of lubricant scraped off the lump of lubricant by a rotation of the first brush roller onto the surface of the image forming body, and the second lubricant coating mechanism comprises a second brush roller provided in contact with a surface of the intermediate transfer member for coating a small amount of lubricant scraped off the lump of lubricant by a rotation of the second brush roller onto the surface of the intermediate transfer member, wherein the first brush roller in the first lubricant coating mechanism is rotated in a direction such that a periphery thereof moves reversely to a progressing direction of the image forming body at a contact area with the image forming body, and is set in a state that a pressing load of the lump of lubricant against the first brush roller is not less than 0.59 N, and a coating amount of lubricant for the image forming body is such that a consumption of the solid lubricant per ten thousand times of image formation is 19.6 mg to 39.1 mg per a length of 1 cm along a rotary axis of the first brush roller, wherein the second brush roller in the second lubricant coating mechanism is rotated in a direction such that a periphery thereof moves in the same direction as a progressing direction of the intermediate transfer member at a contact area with the intermediate transfer member, and is set in a state that a pressing load of the lump of lubricant against the second brush roller is not less than 0.29 N and a coating amount of lubricant for the intermediate transfer member is such that a consumption of the solid lubricant per ten thousand times of image formation is 5.0 mg to 19.5 mg per a length of 1 cm along a rotary axis of the second brush roller, wherein the following specific mutual relation with respect to a surface property between the image forming body and the intermediate transfer member is satisfied:

an angle of contact of the image forming body for pure water when T1 seconds have passed after pure water was dropped on the surface is greater than an angle of contact of the intermediate transfer member for pure water when T1 seconds have passed after pure water was dropped on the surface, where T1 represents a transit time of toner particles through the contact area of the image forming body wit the intermediate transfer member, and wherein the following specific mutual relation with respect to surface property between the intermediate transfer member and the transfer material is satisfied:

an angle of contact of the intermediate transfer member for pure water when T2 seconds have passed after pure water was dropped on the surface is greater than an angle of contact of the transfer material for pure water when T2 seconds have passed after pure water was dropped on the surface, where T2 represents a transit time of toner particles through the contact area of the intermediate transfer member with the transfer material.

4. The image forming apparatus of claim 3, wherein the angle of contact of the image forming member is greater than the angle of contact of the intermediate transfer member by 5° to 30° by the coating of the lubricant on the surface of the image forming body, and the angle of contact of the intermediate transfer member is greater than the angle of contact of the transfer material by 5° to 90° by the coating of the lubricant on the surface of the intermediate transfer member.

5. An image forming apparatus comprising:

(a) an image forming body on which a toner image is formed;

(b) a primary transfer device provided in contact with the image forming body for primarily transferring the toner image formed on the image forming body onto an intermediate transfer member;

(c) a secondary transfer device provided in contact with the intermediate transfer member for secondarily transferring the toner image primarily transferred on the intermediate transfer member onto a transfer material, wherein toner particles adhering to the secondary transfer device are again transferred onto the intermediate transfer member by an electric field to remove the toner particles; and (d) a lubricant coating mechanism comprising a brush roller provided in contact with a surface of the secondary transfer device, and a lump of lubricant which is pressed toward the brush roller, for coating a lubricant on a surface of the secondary transfer device, wherein the brush roller is rotated in a direction such that a periphery thereof moves in the same direction as a progressing direction of the secondary transfer device at a contact area with the secondary transfer device, and is set in a state that a pressing load of the lump of lubricant against the brush roller is not less than 0.29 N, and a coating amount of lubricant for the secondary transfer device is such that a consumption of the solid lubricant per ten thousand times of image formation is 5.0 mg to 39.6 mg per a length of 1 cm along a rotary axis of the brush roller, and the following specific mutual relation with respect to surface property between the intermediate transfer member and the secondary transfer is satisfied:

an angle of contact of the secondary transfer device for pure water when T seconds have passed after pure water was dropped on a surface thereof is greater than an angle of contact of the intermediate transfer member for pure water when T seconds have passed after pure water was dropped n a surface thereof, where T represents a transit time of toner particles through the contact area of the intermediate transfer member with the secondary transfer device.

6. The image forming apparatus of claim 5, wherein the angle of contact of the secondary transfer device is greater than the angle of contact of the intermediate transfer member by 5° to 40° by the coating of the lubricant on the surface of the secondary transfer device.

7. The image forming apparatus of claim 6, wherein the coating amount of lubricant is adjusted by adjusting the pressing load of the lump of lubricant against the brush roller.

8. The image forming apparatus of claim 7, wherein a magnitude of the angle of contact of the intermediate transfer member is adjusted by adjusting the surface roughness of the intermediate transfer member.

9. The image forming apparatus of claim 7, wherein a magnitude of the angle of contact of the intermediate transfer member is adjusted to adjust the magnitude of the angle of contact of said intermediate transfer member by the reforming of the surface of the intermediate transfer ember for wettability by a plasma processing.

10. The image forming apparatus of claim 1, wherein the image carrying body includes a photosensitive member and the transfer material includes an intermediate transfer member.

11. The image forming apparatus of claim 10, wherein the transfer device comprises a primary transfer device and secondary transfer device.

12. The image forming apparatus of claim 11, wherein the primary transfer device transfers the toner image from the photosensitive member to the intermediate transfer member.

13. The image forming apparatus of claim 11, wherein the secondary transfer device transfers the toner image from the intermediate transfer member to a recording sheet.

14. The image forming apparatus of claim 10, wherein the intermediate transfer member is belt type.

15. The image forming apparatus of claim 1, wherein the transfer device includes a roller.

16. The image forming apparatus of claim 10, wherein the intermediate transfer member is provided in correspondence with a plurality of photosensitive members.

* * * * *